US005505302A

United States Patent [19]

Ferley

[11] Patent Number: 5,505,302

[45] Date of Patent: Apr. 9, 1996

[54] TOOLBOX FOR A STEPLADDER

[76] Inventor: Scott R. Ferley, 1022 Bristol La., Missouri City, Tex. 77459

[21] Appl. No.: 322,467

[22] Filed: Oct. 17, 1994

[51] Int. Cl.[6] ..... B65D 85/20; E06C 7/14

[52] U.S. Cl. ..... 206/373; 182/129; 220/751; 248/210; 248/238

[58] Field of Search ..... 248/210, 238, 248/146, 219.2, 217.4, 225.31; 182/33, 129; 206/373; 220/751

[56] References Cited

U.S. PATENT DOCUMENTS

| | | | |
|---|---|---|---|
| 1,933,894 | 11/1933 | Clink | 206/373 X |
| 1,976,765 | 10/1934 | Berry | 206/373 X |
| 3,191,765 | 6/1965 | Dozier | 206/373 X |
| 4,310,134 | 1/1982 | Schopp et al. | 248/210 |
| 4,480,810 | 11/1984 | Hall | 248/238 |
| 4,653,713 | 3/1987 | Hamilton | 248/238 |
| 4,730,802 | 3/1988 | Chatham et al. | 248/238 |
| 4,844,279 | 7/1989 | Chalat | 206/373 X |
| 4,874,147 | 10/1989 | Ory et al. | 248/210 |
| 5,257,695 | 11/1993 | Henke et al. | 206/373 |
| 5,333,823 | 8/1994 | Joseph | 248/210 X |
| 5,370,263 | 12/1994 | Brown | 206/373 X |

*Primary Examiner*—Bryon P. Gehman

[57] ABSTRACT

A toolbox for a stepladder comprising a container having a holding space therein, a sealable opening for selectively allowing and preventing access to the holding space, and an outwardly extending lip adapted for hanging items thereupon; and a coupling mechanism for coupling the container to a stepladder.

1 Claim, 4 Drawing Sheets

TOOLBOX FOR A STEPLADDER

BACKGROUND OF THE INVENTION

1. Field of the Invention

The present invention relates to a toolbox for a stepladder and more particularly pertains to holding items at a location on a stepladder for ready access with a toolbox for a stepladder.

2. Description of the Prior Art

The use of storage devices securable to a ladder is known in the prior art. More specifically, storage devices securable to a ladder heretofore devised and utilized for the purpose of holding items therein for ready access are known to consist basically of familiar, expected and obvious structural configurations, notwithstanding the myriad of designs encompassed by the crowded prior art which have been developed for the fulfillment of countless objectives and requirements.

By way of example, U.S. Patent Des. 324,272 to Thiel discloses a ladder tray attachment. U.S. Pat. No. 3,642,240 to Hershey discloses a handyman's toolbox and ladder accessory. U.S. Pat. No. 4,261,435 to Winter discloses a ladder tray. U.S. Pat. No. 4,913,394 to Schmid discloses a article holding tray assembly for ladder. U.S. Pat. 5,242,031 to Ashley discloses a ladder accessory.

While these devices fulfill their respective, particular objective and requirements, the aforementioned patents do not describe a toolbox for a stepladder that allows tools, screws, bolts, and the like to be held and hung at a location on a stepladder for ready access by a user of the stepladder.

In this respect, the toolbox for a stepladder according to the present invention substantially departs from the conventional concepts and designs of the prior art, and in doing so provides an apparatus primarily developed for the purpose of holding items therein at a location on a stepladder for ready access.

Therefore, it can be appreciated that there exists a continuing need for new and improved toolbox for a stepladder which can be used for holding items therein at a location on a stepladder for ready access. In this regard, the present invention substantially fulfills this need.

SUMMARY OF THE INVENTION

In the view of the foregoing disadvantages inherent in the known types of storage devices securable to a ladder now present in the prior art, the present invention provides an improved toolbox for a stepladder. As such, the general purpose of the present invention, which will be described subsequently in greater detail, is to provide a new and improved toolbox for a stepladder and method which has all the advantages of the prior art and none of the disadvantages.

To attain this, the present invention essentially comprises, in combination, a container. The container is formed of a clear plastic material. The container has a box-shaped body with a rectangular bottom wall and a periphery formed of a front wall, a rear wall, and a pair of opposed side walls. The periphery of the container extends above the bottom wall to form a storage space and a top opening for allowing access to the storage space. The periphery of the container also extends downwards below the bottom wall to form a holding space and a bottom opening for allowing access to the holding space. The container includes a rectangular lip extended outwards from one side wall near the bottom opening with the lip having a plurality of different sized apertures disposed thereon adapted for hanging items. The container includes a first set of spaced dividers disposed within the storage space and extended upwards from the bottom wall and laterally between the front and rear walls. The container includes a second set of dividers disposed within the storage space and perpendicularly interconnected between the dividers of the first set to form a plurality of bins for holding items therein. The container includes a lid hingably secured to the body at the rear wall for selectably preventing and allowing access to the storage space. The container includes a pair of spaced openable metal latches coupled between the lid and the front wall of the container for securing the lid to the body. The container includes a threaded first mounting hole disposed on the rear wall near the bottom opening. The container includes a threaded second mounting hole disposed on the side wall opposite the lip and near the bottom opening. Lastly, the container includes a pair of thumb screws with one thumb screw threadedly disposed within the first mounting hole and with the other thumb screw threadedly disposed within the second mounting hole. The thumb screws are used for coupling the container to a top step of a stepladder when the top step is positioned within the holding space.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toolbox for a stepladder which has all the advantages of the prior art storage devices securable to a ladder and none of the disadvantages.

It is another object of the present invention to provide a new and improved toolbox for a stepladder which may be easily and efficiently manufactured and marketed.

It is a further object of the present invention to provide a new and improved toolbox for a stepladder which is of durable and reliable construction.

An even further object of the present invention is to provide a new and improved toolbox for a stepladder which is susceptible of a low cost of manufacture with regard to both materials and labor, and which accordingly is then susceptible of low prices of sale to the consuming public, thereby making such a toolbox for a stepladder economically available to the buying public.

Still yet another object of the present invention is to provide a new and improved toolbox for a stepladder which provides in the apparatuses and methods of the prior art some of the advantages thereof, while simultaneously overcoming some of the disadvantages normally associated therewith.

Even still another object of the present invention is to provide a new and improved toolbox for a stepladder for holding items therein at a location on a stepladder for ready access.

Lastly, it is an object of the present invention to provide a new and improved toolbox for a stepladder comprising a container having a holding space therein, a sealable opening for selectively allowing and preventing access to the holding space, and an outwardly extending lip adapted for hanging items thereupon; and coupling means for coupling the container to a stepladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
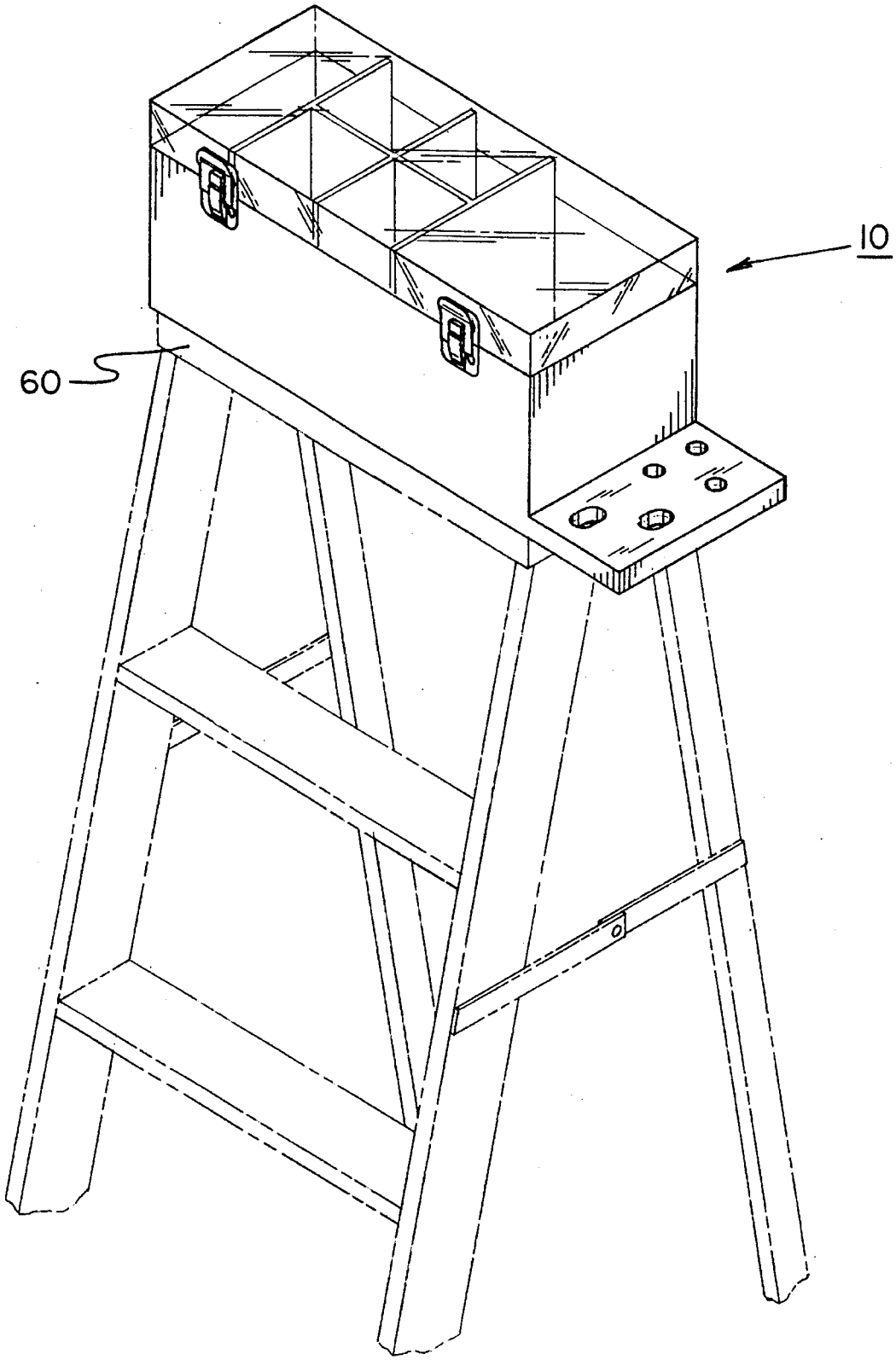
FIG. 1 is a perspective view of the preferred embodiment constructed in accordance with the principles of the present invention secured to a top step of a stepladder.
Figure 2:
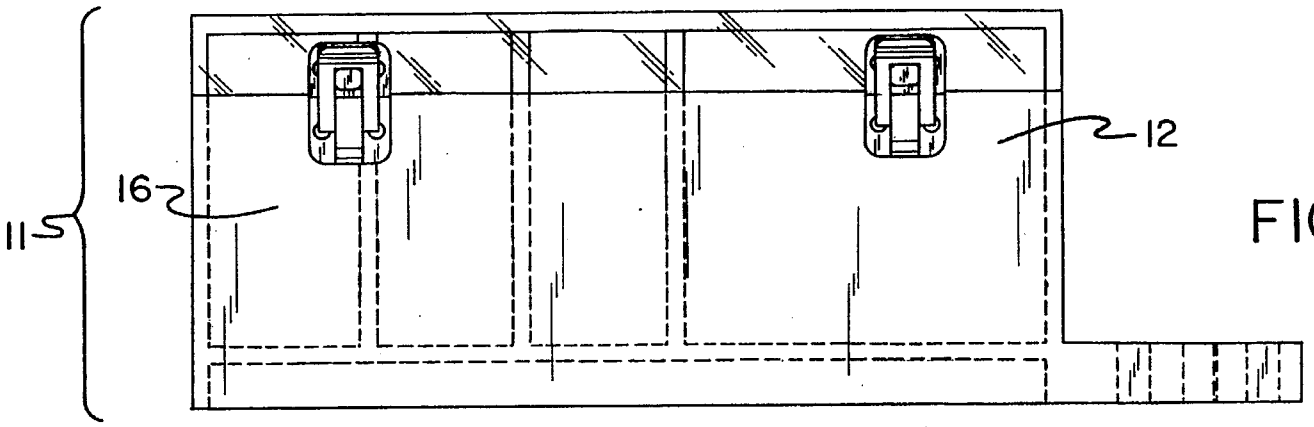
FIG. 2 is a side elevational view of the present invention.
Figure 3:
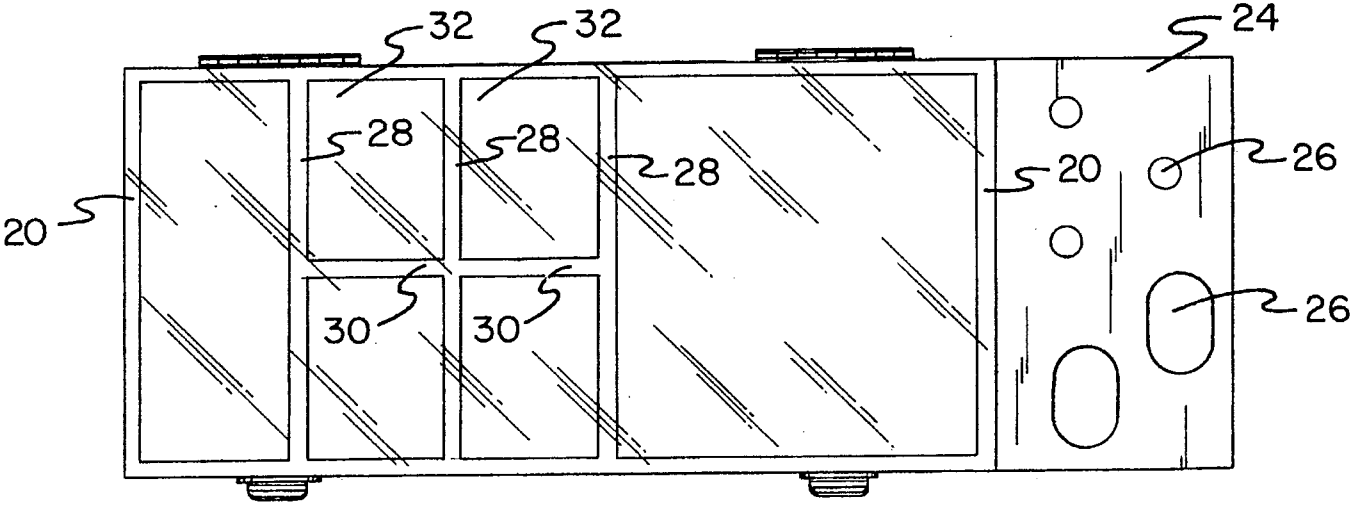
FIG. 3 is a plan view of the present invention as viewed downward toward its lid.
Figure 4:
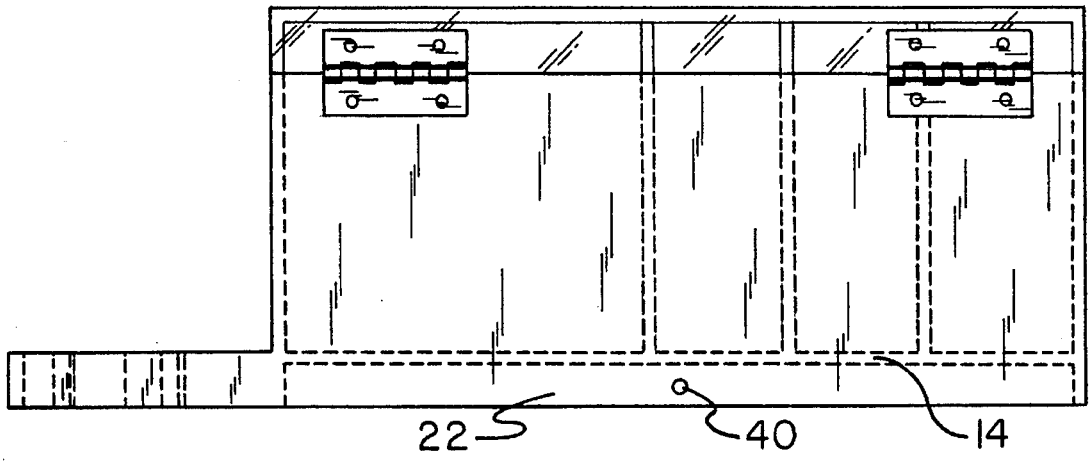
FIG. 4 is yet another side elevational view of the present invention.
Figure 5:
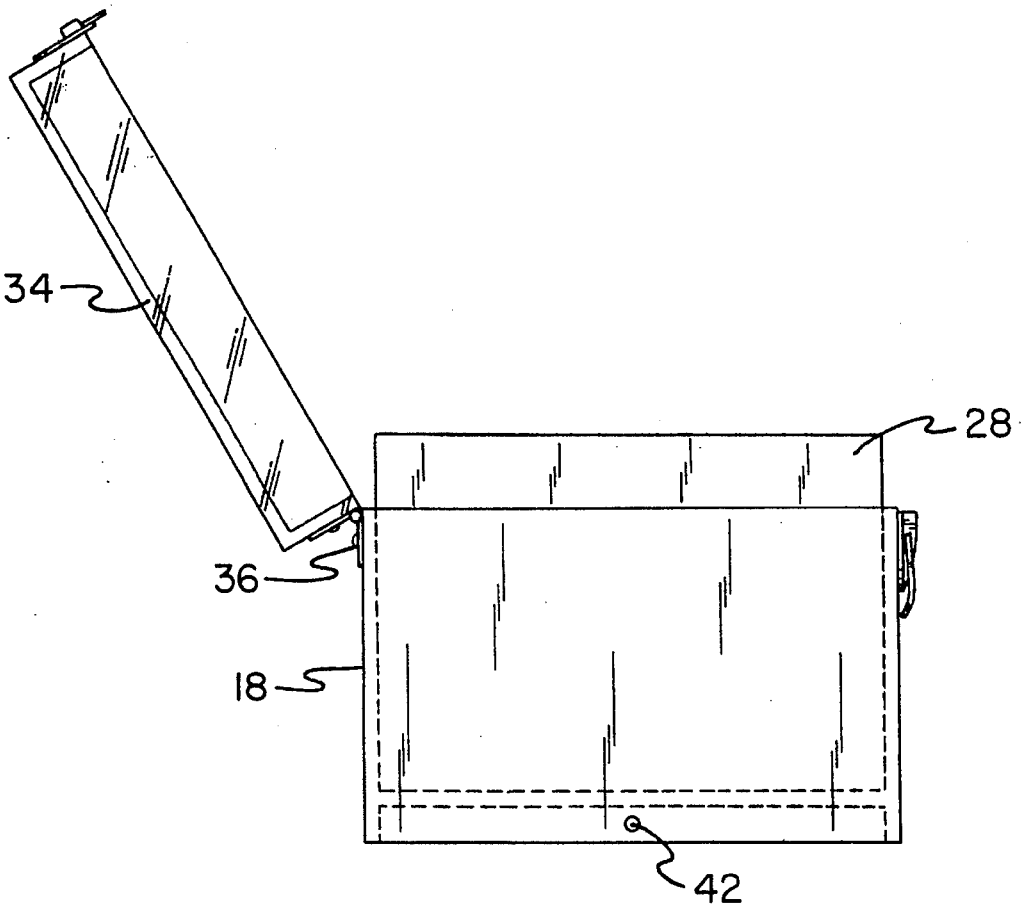
FIG. 5 is still yet another side elevational view of the present invention with its lid open.
Figure 6:
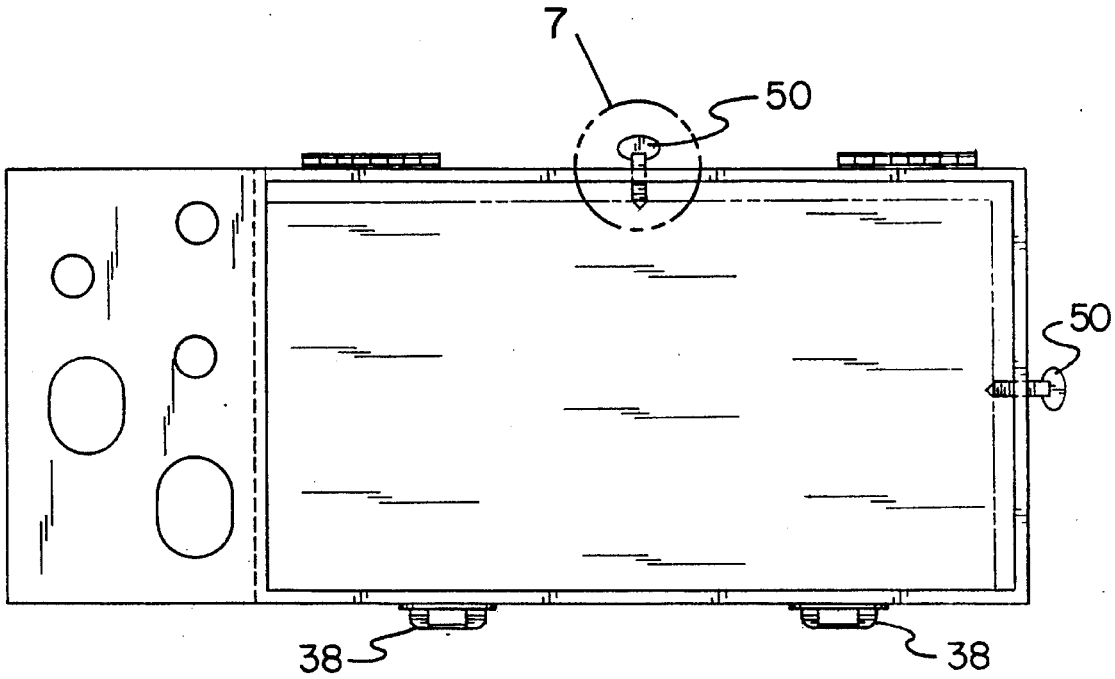
FIG. 6 is a plan view of the present invention illustrating the coupling of the thumbscrews with a top step of a stepladder.
Figure 7:
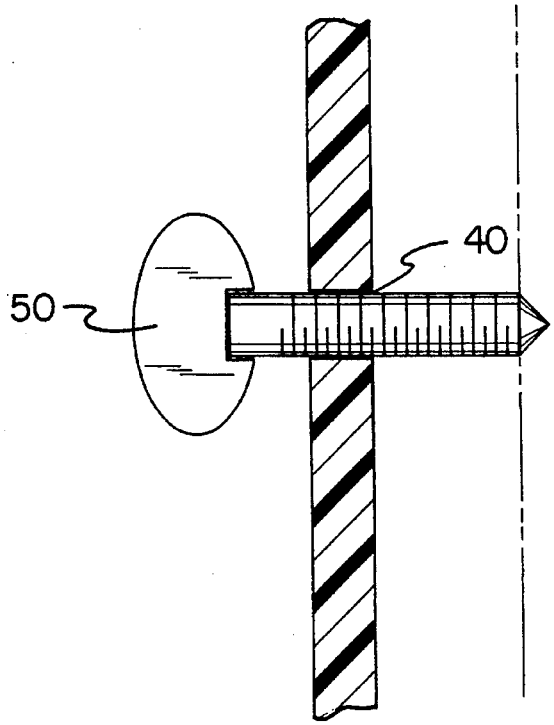
FIG. 7 is a cross-sectional view of the coupling of a thumbscrew with the rear wall of the container.

With reference now to the drawings, and in particular, to FIG. 1 thereof, the preferred embodiment of the new and improved toolbox for a stepladder embodying the principles and concepts of the present invention and generally designated by the reference number 10 will be described.

Specifically, the present invention essentially includes two major components. The major components are the container and thumb screws. These components are interrelated to provide the intended function of holding items at a location for ready access on a step ladder.

More specifically, it will be noted in the various Figures that the first major component is the container 11. The container is rigid in structure and formed of a clear plastic material. The container has a box-shaped body 12. The body has a rectangular, planar horizontal bottom wall 14 with a periphery therearound. The periphery is formed of a planar vertical front wall 16, a planar vertical rear wall 18, and a pair of opposed planar vertical side walls 20 interconnected between the front wall and rear wall. The periphery is extended upwards to form a storage space directly above the bottom wall and a top opening for allowing access to the storage space. The periphery is also extended downwards to form a holding space 22 directly below the bottom wall and a bottom opening for allowing access to the holding space. The container includes a rectangular planar horizontal lip 24 extended outwards from one side wall near the bottom opening. The lip has plurality of different sized apertures 26 disposed thereon. These apertures are used for hanging tools such as a hammer, screwdriver, drill, or the like therein. The container also includes a first set of spaced vertical rectangular planar dividers 28. The first set of dividers are disposed within the storage space and extended upwards from the bottom wall and laterally between the front and rear walls. The container also includes a second set of vertical rectangular planar dividers 30. The second set of dividers are disposed within the storage space and perpendicularly interconnected between the dividers of the first set. The first set and second set of dividers in combination form a plurality of bins 32 for holding items such as screws, bolts and the like therein. The container also includes a lid 34. The lid is generally box-shaped and rigid in structure. The lid coupled to the body at the rear wall with a pair of rigid hinges 36. The hinges are formed of a rigid material such as metal or plastic. The lid allows access to the storage space in one orientation and prevents access thereto in another orientation. The container also includes a pair of spaced openable latches 38 coupled between the lid and the front wall of the container. The latches are formed of a rigid material such as metal or plastic. The latches are used for securing the lid to the body. The container also includes a threaded first mounting hole 40 disposed on the rear wall near the bottom opening. A threaded second mounting hole 42 is also included and disposed on the side wall opposite the lip at a location near the bottom opening.

The second major component of the present invention is the thumb screws 50. The present invention includes a pair of thumb screws. The thumb screws are formed of a rigid material such as metal or plastic. One thumb screw is threadedly disposed within the first mounting hole 40. The other thumb screw is threadedly disposed within the second mounting hole 92. The thumb screws are used for coupling the container to the top step 60 of a step ladder when a top step of a stepladder is positioned within the holding space and the thumb screws are tightened by hand. The container may be removed from the stepladder when the thumb screws are loosened by hand. By securing the top step of the stepladder within the holding space, the stability of the coupling between the present invention and the stepladder is enhanced. Other conventional screws or bolts may also be utilized to perform the coupling function.

The present invention is a toolbox which is attached to the platform or top step at the top of a stepladder, thereby permitting items to be readily at hand for use. The present invention is made of a high strength durable plastic which can be clear to permit the contents to be readily available. The size of the present invention could vary with the size of the application or steps of a stepladder. Access within the present invention is provided through a hinged lid. The present invention is fastened to the platform or stepladder by a suitable means such as screws. The present invention provides a lip with apertures thereon for hanging various tools or related items. A plurality of bins are provided within the present invention for allowing organization and storage of items in a convenient, accessible, identifiable, and retrievable manner. A sturdy latching mechanism formed of a pair of spaced latches holds the lid closed even when the stepladder is folded and carried on its side.

The present invention is used to hold implements and items which are associated with work to be performed by a user. Properly prepared, the present invention eliminates endless climbing up and down of the stepladder by a user to obtain tools, fasteners, and the like. Even tools such as electric drills can be placed upon or hung from the present invention for use. The present invention intended to be utilized by people who hang draperies and shades. It is also readily adapted for use by electricians, contractors, builders, and homeowners.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A toolbox for a stepladder for holding items therein at a location on a stepladder for ready access comprising, in combination:

a container formed of a clear plastic material, the container having a box-shaped body with a rectangular bottom wall and a periphery formed of a front wall, a rear wall, and a pair of opposed side walls, the periphery extended above the bottom wall to form a storage space and a top opening for allowing access to the storage space, the periphery further extended downwards below the bottom wall to form a holding space and a bottom opening for allowing access to the holding space, the container further having a rectangular lip extended outwards from one side wall near the bottom opening with the lip having a plurality of different sized apertures disposed thereon adapted for hanging items, a first set of spaced dividers disposed within the storage space and extended upwards from the bottom wall and laterally between the front and rear walls, a second set of dividers disposed within the storage space and perpendicularly interconnected between the dividers of the first set to form a plurality of bins for holding items therein, a lid hingably secured to the body at a rear wall for selectably preventing and allowing access to the storage space, a pair of spaced openable rigid latches coupled between the lid and the front wall of the container for securing the lid to the body, a threaded first mounting hole disposed on the rear wall near the bottom opening, and a threaded second mounting hole disposed on the side wall opposite the lip and near the bottom opening; and a pair of thumb screws with one thumb screw threadedly disposed within the first mounting hole and with the other thumb screw threadedly disposed within the second mounting hole and with the thumb screws used for coupling the container to a top step of a stepladder when the top step is positioned within the holding space.

* * * * *